US005622002A

United States Patent [19]

Rogers, III et al.

[11] Patent Number: 5,622,002

[45] Date of Patent: Apr. 22, 1997

[54] METHOD FOR REDUCING ABRASION OF TURFGRASS ON ACTIVITY FIELDS

[75] Inventors: John N. Rogers, III, Haslett; Joseph T. Vanini, East Lansing, both of Mich.

[73] Assignee: Board of Trustees operating Michigan State University, East Lansing, Mich.

[21] Appl. No.: 239,868

[22] Filed: May 9, 1994

[51] Int. Cl.[6] ..... A01G 9/02

[52] U.S. Cl. ..... 47/1.01

[58] Field of Search ..... 47/665, 1.01, 1 F

[56] References Cited

U.S. PATENT DOCUMENTS

| | | |
|---|---|---|
| 3,067,542 | 12/1962 | O'Brien . |
| 3,299,567 | 1/1967 | Perkins . |
| 4,166,340 | 9/1979 | Pluenneke . |
| 4,900,010 | 2/1990 | Wengmann et al. . |
| 5,014,462 | 5/1991 | Malmgren et al. . |

FOREIGN PATENT DOCUMENTS

| | | | |
|---|---|---|---|
| 0263566 | 4/1988 | European Pat. Off. | 47/1 F |
| 5184240 | 7/1993 | Japan | 47/1 F |
| 2196539 | 1/1990 | United Kingdom . | |

OTHER PUBLICATIONS

Beard, J.B., Turfgrass Science and Culture, p. 494 (1973).

Rogers, John N. III, et al., Journal Paper No. 8017, Pennsylvania State University, College of Agriculture, Ag. Exp. Station, University Park, PA, pp. 96–110 (1988).

Cockerham, Stephen T., et al., California Turfgrass Culture, 39: (3&4) 9–12 (1984).

Rogers and Waddington, Agronomy Journal 84: 203–209 (1992).

Beard, J. B., Turfgrass: Science and Culture. Prentice Hall. Englewood Cliffs, N.J. (1973).

Waddington, et al., Soil modification for turfgrass areas. Pennsylvania State University. Progress Report 337 (1974).

Nus, J., Influence of amendments in sand on bent–grass establishment. The 38th Northwest Turfgrass Conference. 53–56 (1984).

Baker, S.W., J. Sports Turf Res. Inst. 67:66–82 (1990).

*Primary Examiner*—Terry Lee Melius
*Assistant Examiner*—Joanne C. Downs
*Attorney, Agent, or Firm*—Ian C. McLeod

[57] ABSTRACT

A method for topdressing turfgrass on an activity field with only solid elastomeric particles is described. The method produces turfgrass which has enhanced color and health even when there is extensive abrasion of the grass through use of the field.

16 Claims, 4 Drawing Sheets

CRUMB RUBBER

CRUMB RUBBER

SAND

CRUMB RUBBER

SAND

CRUMB RUBBER

SAND

CRUMB RUBBER

SAND

METHOD FOR REDUCING ABRASION OF TURFGRASS ON ACTIVITY FIELDS

BACKGROUND OF THE INVENTION

1. Field of the Invention

The present invention relates to a method for topdressing an activity field, with essentially solid elastomeric particles, particularly crumb rubber, to reduce abrasion of turfgrass. In particular, the present invention relates to a method wherein the particles produce enhanced greening and health of the turfgrass on an athletic field or playground.

2. Description of Related Art

Topdressing plays many roles in enhancing the turfgrass environment. Among these benefits, include thatch control, smooth surface, modification of the surface soil and winter protection (Beard, J. B., Turfgrass Science and Culture, p. 494, (1973)). Putting greens and sports fields profit from this maintenance practice, primarily because they are high traffic areas and because of the importance of a smooth and uniform surface. In particular, soccer and football fields are subject to more abrasive action due to the nature of the games played on them. A topdressing of a sand/organic matter mix or all sand is used to promote qualities previously mentioned. However, the most intensively worn out areas, usually by mid-season, are past the point of repair, and topdressing does not alleviate the problem. Additionally, sand has abrasive edges, leading to scarification of the crown tissue area or portion of the root. This is detrimental for the playing field due to intense traffic areas on the field becoming the most sparse areas (least dense) of the turf stand. Soccer and football fields show the most wear in between the hashmarks and the goal mouth and in mid-field portions. Further, the abrasive action of the sand is detrimental to turf in areas that are under reduced light conditions (i.e. shade), such as in enclosed stadiums with natural turf, and subsequently reduced growing and recuperative conditions. This effect is magnified especially on low to medium maintenance sports fields. With the absence of turf on the field, the playing quality and aesthetics are dramatically reduced and this ultimately leads to player injuries. Other fields (areas) including horseracing tracks, walk paths, golf course cart paths suffer from abrasive use.

The patent art has shown the amendment of soil with rubber particles, so that the root is below the amendment. U.S. Pat. No. 5,014,462 to Malmgren et al. The rubber particles comprise between 10% to 40% by volume of the amendment with the balance being sand and peat. The problem with this method is that the sand still abrades the root of the turfgrass during use of the turf as a field. Even as much as 80% by volume of rubber to sand produces the same result. Further, the crown of the turfgrass which is at the ground level are not protected by this method, U.K. 2196539A to Heerkens shows a similar method.

U.S. Pat. No. 3,067,542 to O'Brien describes the use of a granular polyurethane foam as a topdressing for soil. The patent is not concerned with turfgrass. The granules in this case are open celled and are too easily dislodged and are not sufficiently rigid to prevent abrasions. U.S. Pat. No. 3,299,567 to Perkins describes the use of fiber glass strands as a topdressing. These are too brittle and can have very sharp edges which damage the root of turfgrass.

U.S. Pat. No. 4,900,010 to Wengmann et al describes the use of a mixture of bark and fibers as a topdressing. The bark is rapidly degraded by use and by decomposition. U.S. Pat. No. 4,166,340 to Pluenneke describes the use of rubber particles on the bottom of a pot for a plant. This does nothing to protect the crown of the plant.

OBJECTS

It is therefore an object of the present invention to provide an improved method for topdressing turfgrass. In particular, it is an object of the present invention to provide a method which is very easy to use with existing topdressing equipment and which is much more economical than the prior art methods. Further still, it is an object of the present invention to provide a method which improves the color and the health of the turfgrass. These and other objects will become increasingly apparent by reference to the following description and the drawings.

DESCRIPTION OF PREFERRED EMBODIMENTS

The present invention relates to a method for protecting a crown portion of turfgrass on an activity area from damage at a ground level from which the turfgrass grows which comprises: applying solid elastomeric particles on the ground level as a topdressing and around the crown portion of the turfgrass in a layer which cover and resist abrasion of the crown portion of the roots as a result of contact with the turfgrass, wherein the particles are essentially free of any other particles which can abrade the crown portion of the turfgrass.

Further the present invention relates to an activity field comprising: water permeable ground supporting a turfgrass in the ground with a crown portion at a ground level; and a layer of solid elastomeric particles which cover the ground level as a topdressing and resist abrasion of the crown portion of turfgrass as a result of contact with the turfgrass when the activity field is used, wherein the particles are essentially free of any other particles which can abrade the crown portion of the root.

Figure 1A:
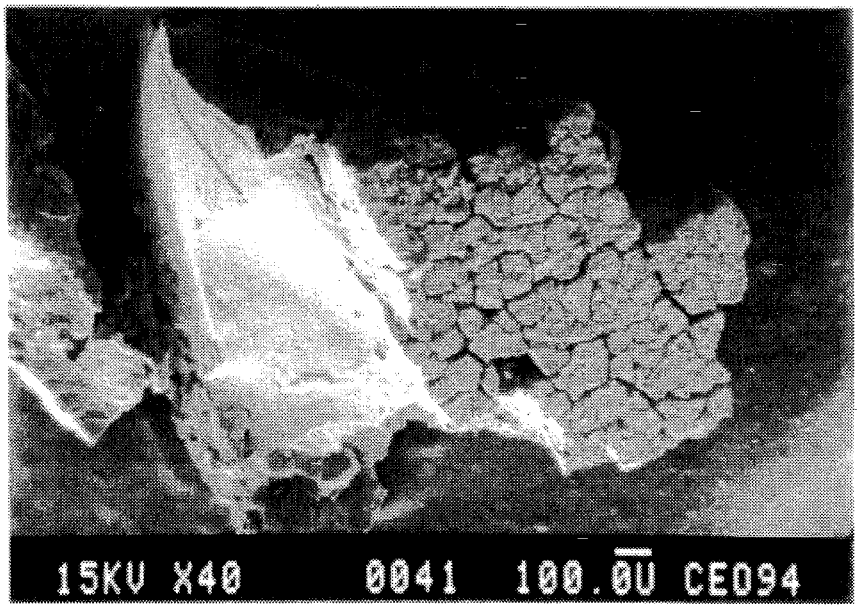
FIG. 1A is an electron microscope photograph of a crumb rubber particle used in the topdressing method of the present invention at 40 times magnification.
Figure 1B:
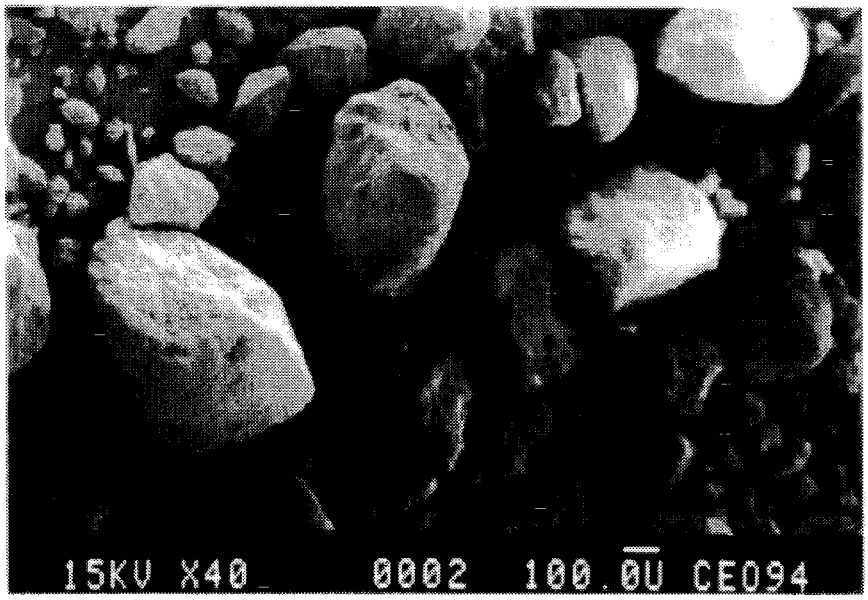
FIG. 1B is an electron microscope photograph of sand particles of the prior art used in topdressing, at 40 times magnification.
Figure 2A:
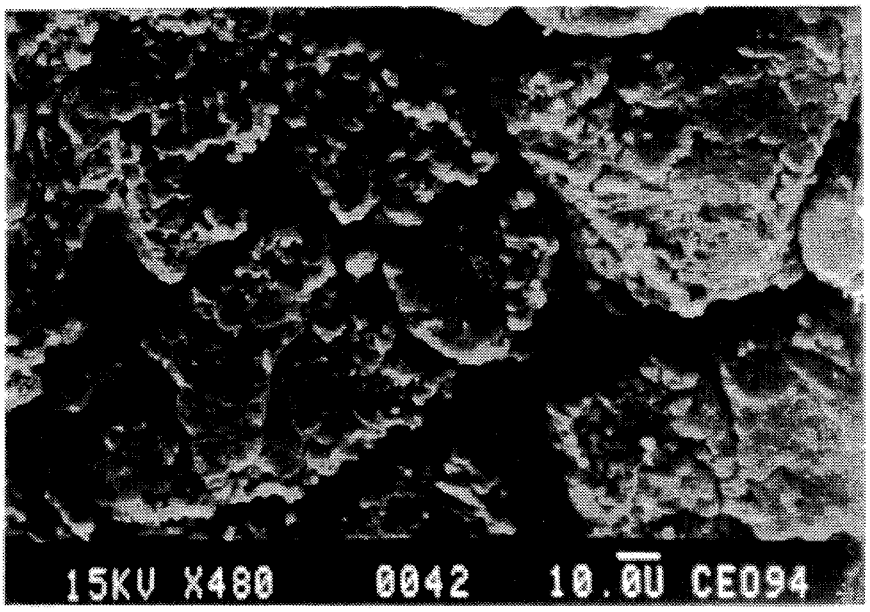
FIG. 2A is an electron microscope photograph of a rough portion of the crumb rubber particle of FIG. 1A at 480 times magnification.
Figure 2B:
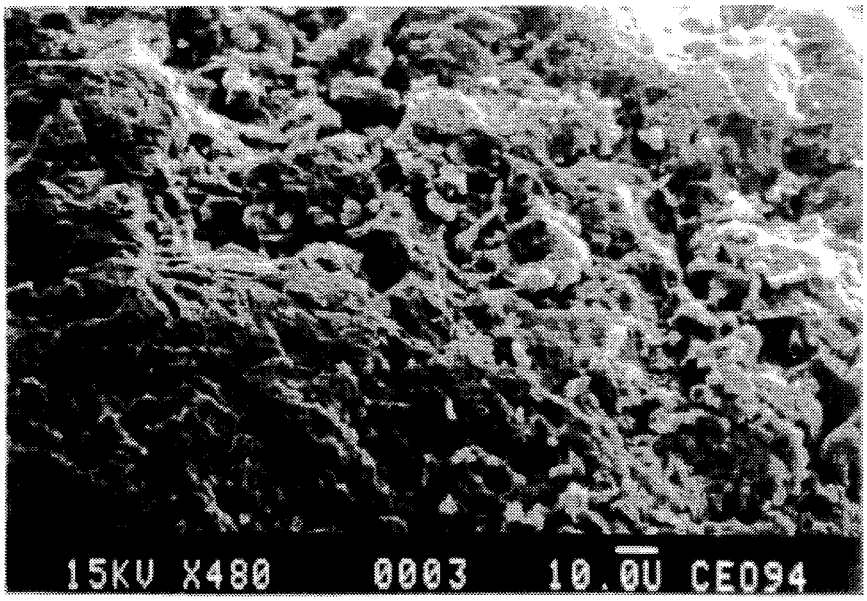
FIG. 2B is a portion of the large left hand sand particle of FIG. 1B at 480 times magnification.
Figure 3A:
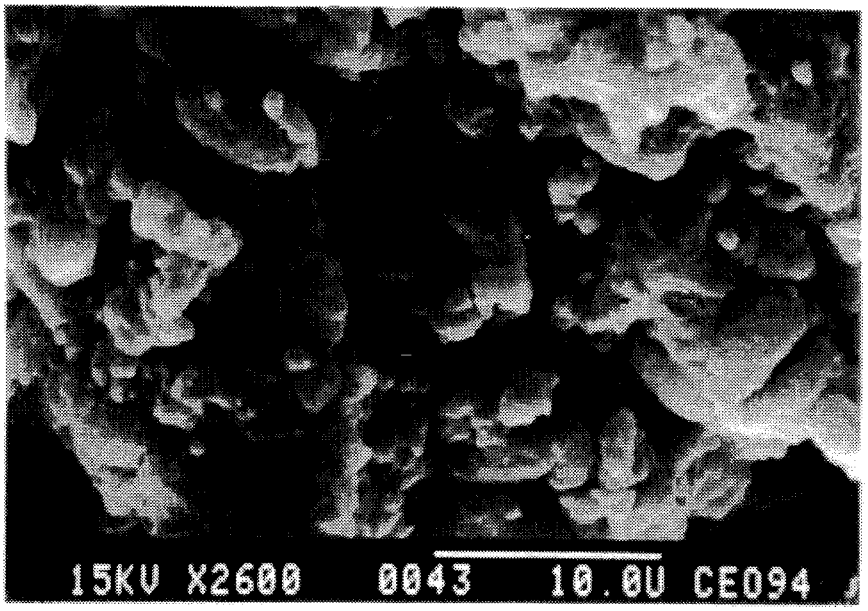
FIG. 3A is an electron microscope photograph of a relatively rough portion of the particle of FIG. 2A at 2600 times magnification showing the character of the surface.
Figure 3B:
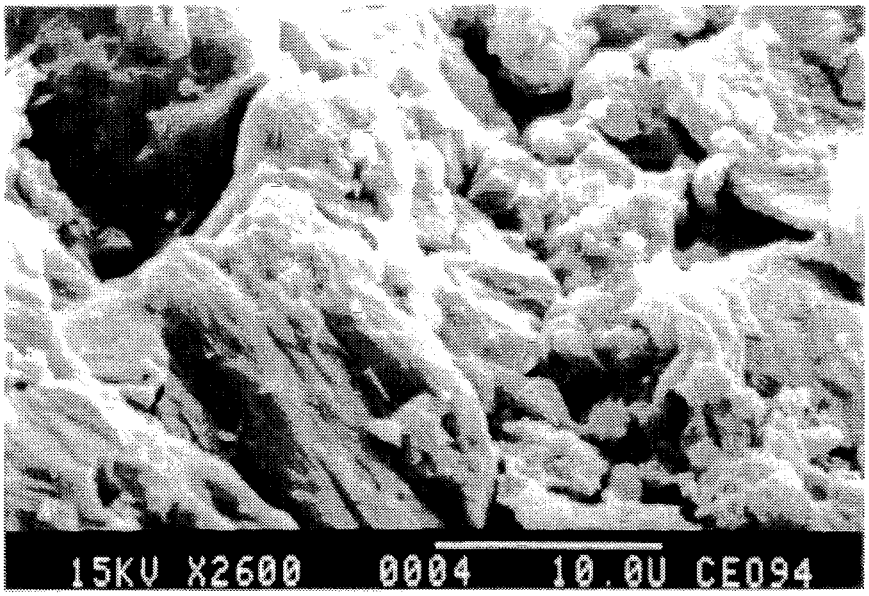
FIG. 3B is an electron microscope photograph of a relatively rough portion of the sand particle of FIG. 2B at 2600 times magnification.
Figure 4A:
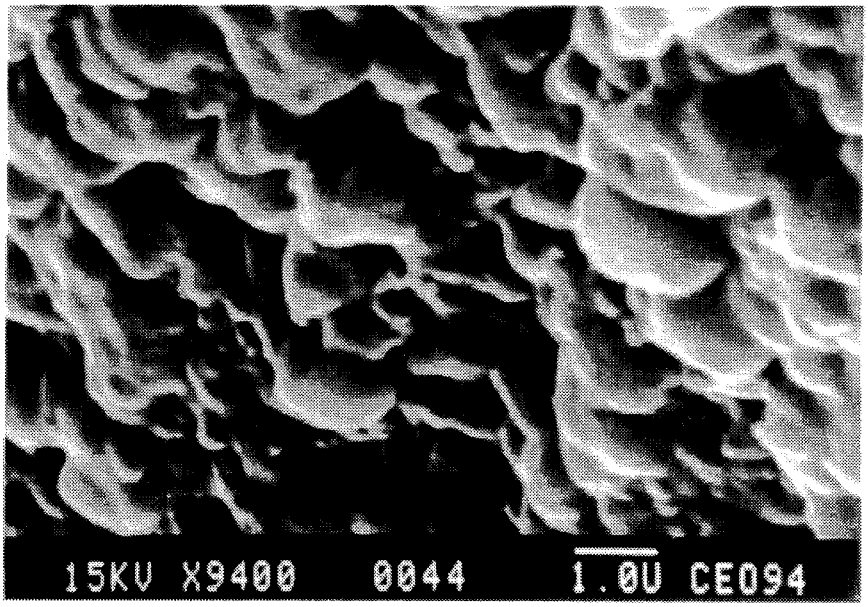
FIG. 4A is an electron microscope photograph of a relatively smooth portion of the particle of FIG. 3A at 9400 times magnification, particularly showing the rounded ridges on the surface of the crumb rubber particle which avoid abrasion of the roots of the turfgrass.
Figure 4B:
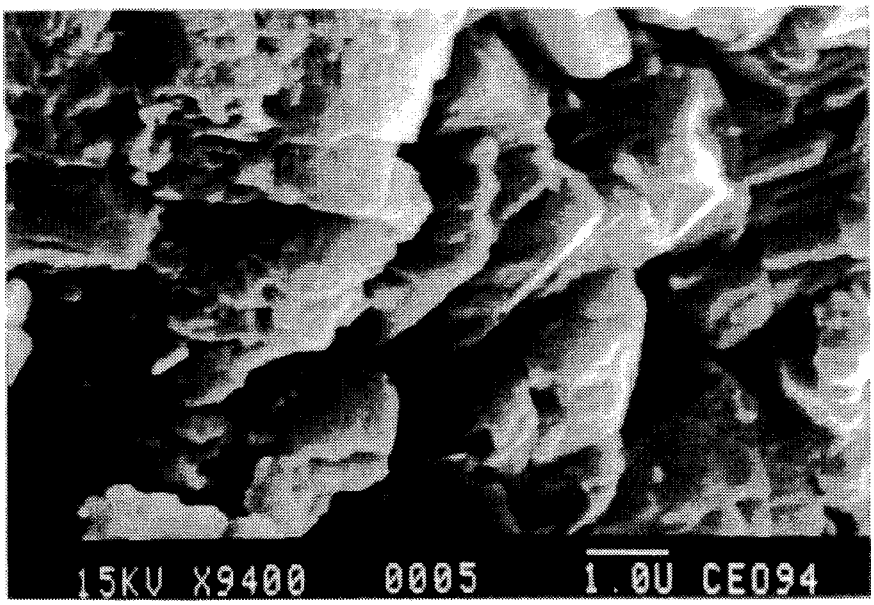
FIG. 4B is an electron microscope photograph of the relatively smooth portion of the sand particle of FIG. 3B of 9400 times magnification showing the very sharp pointed raised portions of the particle which contribute to the abrasion of the roots of the turfgrass when used as a topdressing.

The elastomeric particles are solid (not foamed) and preferably are made of crumb rubber from tires. They are resistant to wear and degradation. The particles are produced using rotary knives as described in a brochure published by John Brown and referred to as the CUMBERLAND 3250 which produces particles having rough and smooth portions as shown in FIGS. 1A to 4A. This method of producing elastomeric (rubber) particles is described in a John Brown equipment brochure for the CUMBERLAND. These particles are uniquely suited to use in the present invention for reasons which are apparent from the scanning electron microscope photographs. The particles have smooth portions and portions which are checkerboarded with cracks. The particles have an average particle size between about 0.01 and 0.6 cm. The particles are preferably used to a depth between about 0.25 and 1.9 cm in the turfgrass.

The elastomeric particles are essentially free of any other particles which can cause abrasion of the crown portion of the root during use of the activity field. In particular, the elastomeric particles are free of sand and like sharp edged particles.

The particles are preferably applied with a rotary plate type spreader and then raked into position on top of the ground level. The equipment for such spreading is well known to those skilled in the art. The ground (soil) supporting the turfgrass preferably has the following composition by volume.

| | |
|---|---|
| Sand | –20–100% particle size 0.05 mm to 2.0 mm |
| Silt | 0–50% 0.002 mm–0.05 mm |
| Clay | 0–50% up to 002 mm. |

Usually the sand component is 40 to 100% by volume for athletic fields where the area is heavily used. The ground is compacted.

Topdressing with crumb rubber, applied in the same manner as any other topdressing, dramatically reduces the abrasive action on the crown portion of the turfgrass caused by the nature of athletic activity. With an increase in surface area and rounder edges of the crumb rubber as shown in FIGS. 1A to 4A versus sand as shown, in FIGS. 1B to 4B, the preferred crumb rubber is able to cushion the crown tissue while still providing a smooth and uniform surface and also improving color and reducing compaction. This improves the playing quality and aesthetics of the playing surface and the safety to the players.

Grasses alone (monostand) or in combination (polystand) which can be used are:

| Common Name | Latin Name |
|---|---|
| I) Cool Season grasses | |
| 1. Perennial ryegrass | *Lolium perenne* |
| 2. Annual ryegrass | *Lolium multiflorum* |
| 3. Creeping bentgrass | *Agrostis palustris* |
| 4. Colonial bentgrass | *Agrostis tenuis* |
| 5. Annual bluegrass | *Poa annua* |
| 6. Kentucky bluegrass | *Poa pratensis* |
| 7. *Poa supina* | *Poa supina* |
| 8. rough bluegrass | *Poa trivialis* |
| 9. Canada bluegrass | *Poa compressa* |
| 10. Tall Fescue | *Festuca arundinacea* |
| 11. Meadow fescue | *Festuca elatior* |

-continued

| Common Name | Latin Name |
|---|---|
| 12. Creeping red fescue | *Festuca rubra* |
| 13. Chewings fescue | *Festuca rubra* v. *communtata* |
| 14. Sheep fescue | *Festuca ovina* |
| 15. hard fescue | *Festuca ovina* v. *duriuscala* |
| II) Warm Season grasses | |
| 16. Common bermudagrass | *Cynodon dactylon* |
| 17. Hybrid bermudagrass | *Cynodon dactylon* x *transvaalensis* |
| 18. Japanese Lawngrass | *Zoysia japonica* |
| 19. Manilagrass | *Zoysia matrella* |
| 20. Mascarengrass | *Zoysia tenufolia* |
| 21. St. Augustinegrass | *Stenotaphrum secundatum* |
| 22. Centipedegrass | *Eremochloa ophiuroides* |
| 23. Carpetgrass | *Axonopus affinis* |
| 24. Bahiagrass | *Paspalum notatus* |
| 25. Kikuyugrass | *Pennisetum clandestinum* |
| 26. Seashore Paspalum | *Paspalum vaginatum* |
| 27. Buffalograss | *Buchloe dactyloides* |

EXAMPLE

A trial plot was established on an 80% sand to 20% peat at the Robert Hancock Turfgrass Research Center at Michigan State University, East Lansing, Mich. on 29 Jul. 1993 to determine optimum topdressing rates for high trafficked areas, especially high school athletic fields and playgrounds. Crumb rubber was topdressed in a 2×5 randomized complete block design with three replications. There were two levels of crumb rubber (10 mesh (average particle size 0.1 to 0.2 cm) and ¼" size—0.635 cm) and five treatment amounts (0", 0.05", 0.10", 0.125" and 0.25" or 0.127 cm, 0.254 cm, 0.318 cm and 0.635 cm average particle size) of crumb rubber added to the surface). Crumb rubber was topdressed with a SCOTT'S (Marysville, Ohio) rotary spreader and then dragged in for as even distribution as possible on a *Lolium perenne* (Perennial ryegrass) and *Poa pratensis* (Kentucky bluegrass) turfgrass stand. Treatment areas were 3.0 m×3.6m. The rubber particles settles down to the soil surface, thus protecting the crown tissue area at ground level. The rubber stays at the soil surface or ground level because of being lighter or having a lower particle density; rubber's average particle density is 1.1 g/cc versus soil average particle density being 2.65 g/cc, on average. At the same time, crumb rubber is reducing impact absorption (surface hardness measured with the Clegg Impact Test) (Rogers, John N. III, et al., Journal Paper No. 8017, Pennsylvania State University, College of Agriculture, Agricultural Experiment Station, University Park, Pa., p. 96–110 (1988)), reducing compaction (thereby providing a favorable environment for growth and recovery), and improving turfgrass color.

Wear treatments were initiated on 26 August and ran through 14 November and was applied by the Brinkman Traffic Simulator (BTS) (Cockerham, Stephen T., et al., California Turfgrass Culture, 39:(3&4) 9–12 (1984)). Two passes by the BTS is equivalent to the traffic experienced in one football game between the forty yard lines between the hashmarks. Subsequently, in this 81-day period, 49 football games were simulated.

Crumb rubber was topdressed, at the above mentioned rates, on 29 July, 11 September and 5 October. The results are shown in Tables 1 to 5. Impact absorption values were significantly lower at 0.25 (depth on ground) crumb rubber except on 11 September and 19 November, as shown in Table 1.

TABLE 1

Impact Absorption values for the Trafficked Areas of the Crumb Rubber Topdressing Study at the Hancock Turfgrass Research Center, 1993.

| | Impact Absorption (gmax) | | | | | | |
|---|---|---|---|---|---|---|---|
| Particle Size | Sept 11 a | Sept 20 b | Sept 29 b | Oct 22 c | Nov 5 c | Nov 19 c | Dec 3 c |
| 6 mm | 70.7 | 67.4 | 64.8 | 66.8 | 66.8 | 78.6 | 67.9 |
| 10/20 mesh | 72.5 | 70.2 | 66.0 | 66.9 | 68.0 | 79.3 | 68.6 |
| Significance | -NS- | * | -NS- | -NS- | -NS- | -NS- | -NS- |
| Treatment | | | | | | | |
| Check | 70.1 | 70.5 | 66.8 | 69.0 | 67.6 | 92.6 | 67.4 |
| 0.05" | 72.6 | 70.4 | 65.8 | 71.7 | 69.8 | 79.0 | 71.7 |
| 0.10" | 73.8 | 72.0 | 69.2 | 71.3 | 72.2 | 76.4 | 72.5 |
| 0.125" | 71.8 | 68.4 | 64.4 | 66.1 | 65.6 | 77.8 | 70.0 |
| 0.25" | 70.0 | 62.8 | 60.7 | 56.1 | 60.7 | 79.1 | 59.5 |
| LSD (0.05) | -NS- | 3.2 | 3.6 | 3.4 | 5.6 | -NS- | 4.8 |

a. 1st topdressing - July 29
b. 2nd topdressing - September 11
c. 3rd topdressing - October 5
*indicates a significant difference at the 0.05 level.
Note These dates are the same for all the tables represented.

The amount of crumb rubber on a treatment area would double or triple depending on testing date. On September 20, the amount on the ground for that testing date, in respective order, 0", 0.10", 0.20", 0.025" and 0.50" or on October 22, the amount on the treatments are 0", 0.15", 0.30", 0.375" and 0.75".

(the lower the impact value, the softer the surface).

The remaining rates tended to be inconsistent and particle size was not significant except on 20 September. Shear resistance values in regards to particle size were not significant for the testing dates except 22 October, as shown in Table 2.

TABLE 2

Shear Resistance values for the Trafficked Areas of the Crumb Rubber Topdressing Study at the Hancock Turfgrass Research Center, 1993.

| | Shear Resistance (N/M) | | | |
|---|---|---|---|---|
| Particle Size | Sept 20 b | Sept 29 b | Oct 22 c | Nov 5 c |
| 6 mm | 21.4 | 21.1 | 16.0 | 14.0 |
| 10/20 mesh | 22.3 | 21.2 | 17.5 | 15.7 |
| Significance | -NS- | -NS- | * | -NS- |
| Treatment | | | | |
| Check | 25.6 | 24.4 | 20.7 | 17.6 |
| 0.05" | 23.7 | 24.7 | 20.2 | 17.0 |
| 0.10" | 22.5 | 21.6 | 15.3 | 16.2 |
| 0.125" | 22.1 | 21.1 | 15.3 | 13.3 |
| 0.25" | 15.0 | 14.0 | 12.2 | 10.3 |
| LSD (0.05) | 2.3 | 3.3 | 2.2 | 2.8 |

*indicates a significant difference at the 0.05 level.

TABLE 3

Surface Temperature values for the Trafficked Areas of the Crumb Rubber Topdressing Study at the Hancock Turfgrass Research Center, 1993.

| | Surface Temperature (°F.) | | | | | |
|---|---|---|---|---|---|---|
| Particle Size | Aug 18 a | Sept 20 b | Sept 29 b | Oct 22 c | Nov 5 c | Dec 3 c |
| 6 mm | 84.7 | 58.9 | 57.4 | 49.0 | 46.2 | 39.1 |
| 10/20 mesh | 84.8 | 58.8 | 57.4 | 49.8 | 46.4 | 39.1 |
| Significance | -NS- | -NS- | -NS- | -NS- | * | -NS- |
| Treatment | | | | | | |
| Check | 83.0 | 59.1 | 57.1 | 47.5 | 46.1 | 38.9 |
| 0.05" | 84.0 | 59.0 | 57.4 | 48.5 | 46.1 | 39.0 |
| 0.10" | 85.2 | 58.8 | 57.2 | 49.0 | 46.4 | 39.1 |
| 0.125" | 85.9 | 58.9 | 57.4 | 49.0 | 46.4 | 39.1 |
| 0.25" | 85.9 | 58.4 | 57.7 | 50.6 | 46.4 | 39.3 |
| LSD (0.05) | 1.8 | -NS- | 0.5 | 1.5 | 0.2 | -NS- |

Note - August 18 was a testing date before any traffic was applied by the Brinkman Traffic Simulator (BTS).
*indicates a significant difference at the 0.05 level.

TABLE 4

Color Ratings for the Trafficked Areas of the Crumb Rubber Topdressing Study at the Hancock Turfgrass Research Center, 1993.

| | Color Ratings | | | |
|---|---|---|---|---|
| Particle Size | Sept 22 b | Oct 1 b | Oct 25 c | Nov 15 c |
| 6 mm | 6.2 | 6.2 | 6.3 | 3.8 |
| 10/20 mesh | 5.9 | 5.8 | 5.6 | 3.2 |
| Significance+ | -NS- | -NS- | * | -NS- |
| Treatment | | | | |
| Check | 4.8 | 5.3 | 4.0 | 2.7 |
| 0.05" | 5.7 | 5.6 | 5.7 | 3.2 |
| 0.10" | 5.7 | 5.8 | 6.2 | 3.4 |
| 0.125" | 6.2 | 6.0 | 6.2 | 3.0 |
| 0.25" | 7.8 | 7.2 | 7.7 | 5.2 |
| LSD (0.05) | 1.0 | -NS- | 1.1 | 1.1 |

Note Scale for Color Ratings: 1–9; 1-Brown, 9-Best, 6-Acceptable
*indicates a significant difference at the 0.05 level.

TABLE 5

Crumb Rubber Sieve Analysis for the Crumb Rubber Topdressing Study at the Hancock Turfgrass Research Center, 1993.

| Category (Size range) | Sand (%)[1] | ¼" size (%) | 10/20 mesh (%) |
|---|---|---|---|
| Gravel (>2 mm) | .9 | 93.3 | 16.6 |
| Very Coarse (1–2 mm) | 8.8 | 3.7 | 39.4 |
| Coarse (1–.50 mm) | 44.3 | 1.5 | 17.5 |
| Medium (.50–.25 mm) | 39.6 | 1.3 | 22.4 |
| Fine (.25–.10 mm) | 5.8 | 0.2 | 3.8 |
| Very Fine (.10–.05 mm) | 0.6 | 0.0 | 0.3 |
| Total Percentage | 100 | 100 | 100 |

Note All particle size figures are averaged over three samples.
[1]The sieve analysis of the sand used for the modified rootzone for the Crumb Rubber Topdressing Study at the Hancock Turfgrass Research Center.

For topdressing rate and its effects on shear resistance, every testing date was significant; the lower the amount of crumb rubber the higher the shear resistance value. Soil temperature values were significant in regards to the treatments except on 20 September and 3 December. The 0.25" (0.635 cm) crumb rubber rate tended to have the highest temperature while the check (control) treatment tended to have the lowest values. Crumb rubber particle size was not significant except on 5 November. The effect of crumb rubber on soil temperatures was significant due to the relationship between turfgrass growth and soil temperature. As soil temperatures drop below 50° F. the growth and recovery of turfgrass slows. These falling temperatures directly coincide with the football season and can lead to playing quality problems. Keeping temperatures higher can lead to increased playing quality conditions. Color ratings provide even more substantial evidence of improving playing field conditions, in this case aesthetically. For all of the testing dates, the highest color rating followed suit with the highest level of crumb rubber treatment (except 1 October). Particle size was not significant except on 25 October.

Overall, first year data did reveal the importance crumb rubber has in reducing impact absorption as well as improving soil temperatures and turf color. The data shows that crumb rubber can provide as an effective tool for improving turfgrass as well as soil characteristics under high traffic conditions.

It is intended that the foregoing description be only illustrative of the present invention and that the present invention be limited only to the hereinafter appended claims.

We claim:

1. A method for protecting a crown portion of turfgrass on an activity area from damage at a ground level above soil from which the turfgrass grows which comprises:

applying solid elastomeric particles in at least two applications over time to the turfgrass and raking the particles into the turfgrass without mixing the particles into the soil so that the particles are distributed around the crown portion of the turfgrass in a layer which covers the crown portion of the turfgrass and resists abrasion of the crown portion as a result of the activity on the turfgrass, wherein the particles are essentially free of any other particles which can abrade the crown portion of the turfgrass.

2. The method of claim 1 wherein the applying in the at least two applications is of the particles which have an average size between about 0.01 and 0.6 cm.

3. The method of claim 1 wherein the applying in the at least two applications is of the layer which has a thickness between about 0.25 and 1.9 cm.

4. The method of claim 1 wherein the applying in the at least two applications is of the particles which are from ground rubber tires and have an average particle size between about 0.01 and 0.6 cm.

5. The method of claim 1 wherein the applying in the at least two applications is of the layer which has a thickness around the crown portion of the turfgrass which improves color and growth of the turfgrass compared to turfgrass grown without the layer.

6. The method of claim 5 wherein the applying in the at least two applications is of the layer which provides an increased temperature of the ground around the turfgrass compared to the ground without the layer of the particles.

7. The method of claim 4 wherein the applying in the at least two applications is of the layer which has a thickness around the crown portion of the turfgrass which improves color and growth of the turfgrass compared to turfgrass grown without the layer.

8. The method of claim 7 wherein the applying in the at least two applications is of the layer which provides an increased temperature of the ground around the turfgrass compared to the ground without the layer of the particles.

9. An activity field with turfgrass which grows above ground level above a soil comprising:

(a) water permeable ground supporting the turf grass in the ground with a crown portion at the ground level above the soil; and (b) a layer of solid elastomeric particles which has been applied in at least two applications to the turfgrass and raked into the turfgrass without mixing the particles into the soil so that the particles are distributed around the crown portion of turfgrass in a layer which covers the crown portion of the turfgrass and resists abrasion of the crown portion as a result of the activity on the turfgrass, wherein the particles are essentially free of any other particles which can abrade the crown portion of the turfgrass.

10. The activity field of claim 9 wherein the particles have an average size between about 0.01 and 0.6 cm.

11. The activity field of claim 9 wherein the layer has a thickness between about 0.25 and 1.9 cm.

12. The activity field of claim 9 wherein the particles are from ground rubber tires and have an average particle size between about 0.01 and 0.6 cm.

13. The activity field of claim 9 wherein the layer has a thickness around the crown portion of the turfgrass which improves color and growth of the turfgrass compared to turfgrass grown without the layer.

14. The activity field of claim 13 wherein the layer provides an increased temperature of the ground around the turfgrass compared to the ground without the layer of the particles.

15. The activity field of claim 12 wherein the layer has a thickness around the crown portion of the turfgrass which improves color and growth of the turfgrass compared to turfgrass grown without the layer.

16. The activity field of claim 15 wherein the layer provides an increased temperature of the ground around the turfgrass compared to the ground without the layer of the particles.

* * * * *